US009604265B2

(12) United States Patent
Schmit et al.

(10) Patent No.: US 9,604,265 B2
(45) Date of Patent: Mar. 28, 2017

(54) OSCILLATING FLUID JET ASSEMBLY

(76) Inventors: Steve J. Schmit, Elk River, MN (US); Ryan M. Smith, Minnetonka, MN (US); Nathan R. Perkins, Rogers, MN (US)

( * ) Notice: Subject to any disclaimer, the term of this patent is extended or adjusted under 35 U.S.C. 154(b) by 1297 days.

(21) Appl. No.: 13/168,626

(22) Filed: Jun. 24, 2011

(65) Prior Publication Data

US 2012/0000495 A1 Jan. 5, 2012

Related U.S. Application Data

(60) Provisional application No. 61/358,247, filed on Jun. 24, 2010.

(51) Int. Cl.

| | |
|---|---|
| ***B08B 9/093*** | (2006.01) |
| ***B08B 3/02*** | (2006.01) |
| ***F42B 33/06*** | (2006.01) |
| ***F42B 33/10*** | (2006.01) |

(52) U.S. Cl.
CPC ..... *B08B 9/0936* (2013.01); *F42B 33/062* (2013.01); *F42B 33/10* (2013.01)

(58) Field of Classification Search
USPC ..... 86/50
See application file for complete search history.

(56) References Cited

U.S. PATENT DOCUMENTS

| | | | | |
|---|---|---|---|---|
| 3,420,444 | A * | 1/1969 | Ajnefors | 239/227 |
| 3,444,869 | A * | 5/1969 | Guignon, Jr. et al. | 134/167 R |
| 4,056,227 | A * | 11/1977 | Fismen | 239/227 |
| 7,225,716 | B1 * | 6/2007 | Miller et al. | 86/50 |
| 7,328,643 | B2 * | 2/2008 | Goetsch et al. | 86/50 |
| 2006/0243307 | A1 * | 11/2006 | Jinback | 134/22.1 |

* cited by examiner

*Primary Examiner* — Michael Barr
*Assistant Examiner* — Benjamin L Osterhout
(74) *Attorney, Agent, or Firm* — Henry E. Naylor

(57) ABSTRACT

A fluid jet assembly for washing out material from a cavity. The fluid jet is capable of oscillating in a overlapping revolutions to ensure complete washout of the material in the cavity, preferably an energetic-containing material.

10 Claims, 9 Drawing Sheets

III

II

I

OSCILLATING FLUID JET ASSEMBLY

CROSS-REFERENCE TO RELATED APPLICATIONS

This application is based on U.S. Provisional Application 61/358,247 filed Jun. 24, 2010.

FIELD OF THE INVENTION

The present invention relates to a fluid jet assembly for washing out material from a cavity. The fluid jet is capable of oscillating in overlapping revolutions to ensure substantially complete washout of the material in the cavity. A preferred material is an energetic material located inside of a munition, or ordnance.

BACKGROUND OF THE INVENTION

Surplus munitions present a problem to the US military. Current budget constraints force the US military to prioritize its spending while effectively defending the interests of the United States. Defense budgets are further tightened because aging and surplus munitions must be guarded and stored. The US military regularly destroys a significant amount of its surplus munitions each year in order to meet its fiscal challenge. It also destroys a significant amount of munitions each year due to deterioration and obsolescence.

In the past, munitions stocks were disposed of by open burn/open detonation (OBOD) methods—the most inexpensive and technologically simple disposal methods available. Although such methods can effectively destroy munitions, they fail to meet the challenge of minimizing potentially hazardous waste by-products in a cost effective manner. Furthermore, such methods of disposal are undesirable from an environmental point of view because they contribute to the pollution of the environment. For example, OBOD methods produce relatively high levels of $NO_x$, acidic gases, particulates, and metal waste. Incomplete combustion products can also leach into the soil and contaminate ground water from the pits used for open burn methods. The surrounding soil and ground water must often be remediated after OBOD to meet environmental guidelines.

Conventional incineration methods can also be used to destroy munitions, but they require a relatively large amount of fuel. They also produce a significant amount of gaseous effluent that must be treated to remove undesirable components before they can be released into the atmosphere. Thus, OBOD and incineration methods for disposing of munitions have become impractical owing to increasingly stringent federal and state environmental protection regulations. Further, today's ever stricter environmental regulations require that new munitions and weapon system designs incorporate demilitarization processing issues. Increasingly, stringent EPA regulations will not allow the use of OBOD or excessive incineration techniques, so new technologies must be developed to meet the new guidelines.

U.S. Pat. Nos. 7,225,716 and 7,328,643, both of which are incorporated herein by reference, teach the use of a fluid jet technology for cutting open explosive shells and removing the energetic material. Various fluids can be used, including water and solvents in which the energetic material is soluble. The fluid jet can also carry an abrasive component, such as garnet, to enhance the rate of cutting. These patents do not suggest the oscillation of the fluid jet wand during wash-out of energetic material.

While some of the above methods have met with varying degrees of success, there still remains a need in the art for improved methods and apparatus for demilitarizing munitions in an efficient, safe, and environmentally friendly manner.

SUMMARY OF THE INVENTION

In accordance with the present invention there is provided an apparatus for delivering one or more jets of high pressure fluid for washing out material contained within a containing space defined by enclosing walls, which apparatus comprises:

a) a wand comprised of a length of metallic tubing having an outlet end and an inlet end;

b) a nozzle containing one or more orifices for delivering one or more jets of high pressure fluid, which nozzle being in fluid communication and secured to the outlet end of said wand;

c) a tubular coiled structure in the form of a plurality of horizontally positioned loops wherein there is a top loop and a bottom loop, and having an outlet end extending substantially vertically from said top loop and an inlet end extending from the bottom loop, wherein said outlet end of said tubular structure is fluidly connected to the inlet end of said wand and wherein said inlet end of said tubular coiled structure is fluidly connected to a source of high pressure fluid;

d) a means for oscillating said wand about its longitudinal axis; and e) a first supporting structure for supporting at least some of items of a)-d) above; and f) a means for translating said wand along its longitudinal axis for extending said wand and nozzle upward into the interior of said containing space and downward out of said containing space.

In a preferred embodiment, the tubular coil structure is secured at ground level.

In another preferred embodiment, the means for oscillating the wand is a rotary actuator.

In yet another preferred embodiment, the rotary actuator is a hollow bore type of rotary actuator.

DETAILED DESCRIPTION OF THE INVENTION

Figure 1:
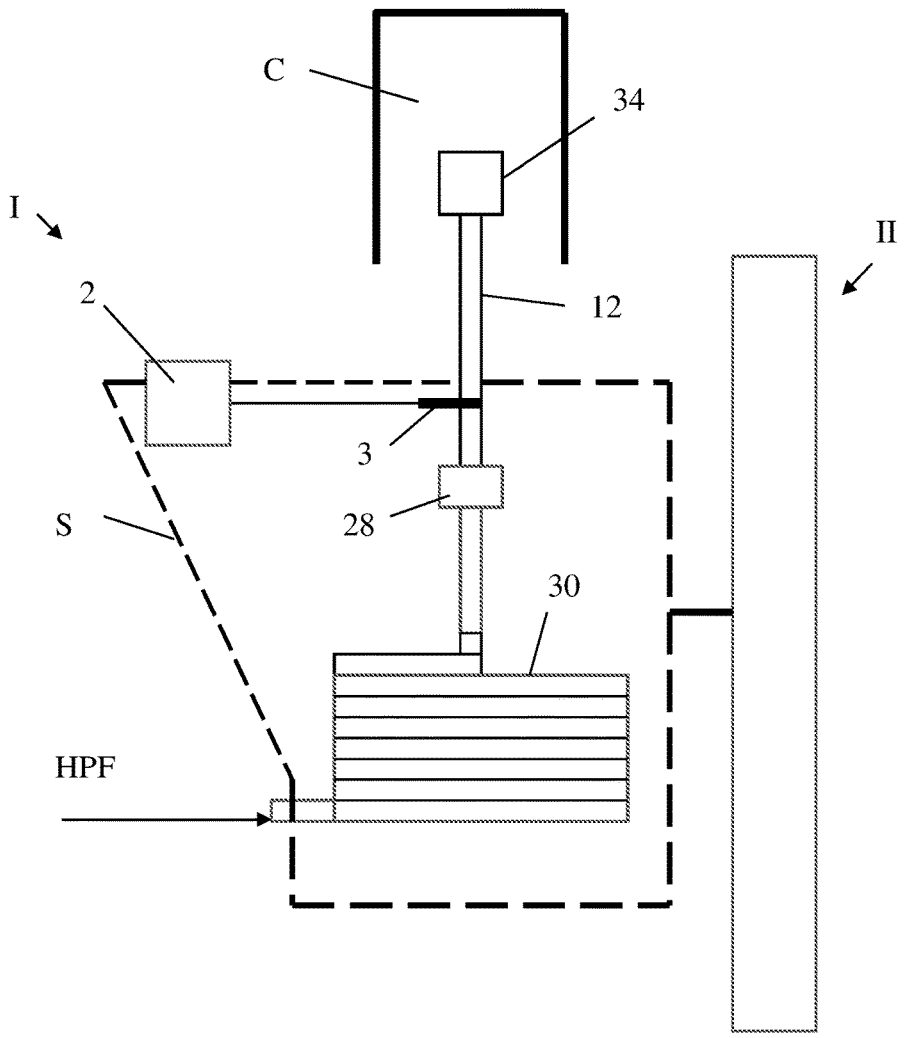
FIG. 1 hereof is a generic representation of the apparatus of the present invention.

The present invention relates to a fluid jet assembly for washing out material from the cavity of an object. A preferred material is an energetic material located inside of a munition, or ordnance. During operation, one or more, preferably two or more, high pressure jets of fluid, preferably water, emanates radially outward from a nozzle residing along the longitudinal axis of the cavity. When the nozzle is situated within the cavity, the nozzle and object are limited to two degrees of freedom relative to each other. These are: translation along the axis, and angular displacement about the axis. In order for a successful wash-out, both motions must be utilized so that the plurality of jets can deliver direct impact energy to the entire interior surface of the cavity. It is preferred that the object be keep stationary for a variety of reasons. For example, the object will be substantially larger than the nozzle so the object will require larger components to impart motion to the object. The object will also be heavier than the nozzle, thus it will take more energy to impart motion to it. The object will also be at a higher elevation than the nozzle so it becomes important to prevent the object from falling. It is easier to prevent a stationary object from falling than one that is in motion. Also, if the object is a munition, which is inherently hazardous, the hazards will be amplified by any disturbance to the munition. Thus, in order to keep the object stationary, the nozzle must be able to achieve both motions. Of primary concern is the method for achieving the angular displacement. Instead of rotating the nozzle through continuous revolutions about its' axis, which would be maintenance intensive and cost prohibitive, the present invention oscillates the nozzle about the axis. In doing so, the need for a rotary union is eliminated and therefore the system of the present invention, which instead uses a coil, is more efficient and reliable. The degree of oscillation required to ensure that the full circumferential area of the cavity receives direct jet impact energy depends on how the orifices are arranged on the nozzle. At most, this requirement would be slightly over one hundred and eighty degrees in each direction from neutral.

The preferred object to be washed-out is a munition having a cavity containing an energetic material. The munition can be any type of munition, non-limiting examples which include projectiles, shells, bombs etc. The most preferred size of the object, particularly an ordnance, is from about 3 inches to about 10 inches in diameter, although smaller and larger diameter objects can also be accommodated. Munitions are typically comprised of a cylindrical metal outer casing of suitable thickness having a tapered forward, or nose, section and a flat rear, or base section. The interior of the munition contains the energetic material. It will be understood that the terms munition, ordnance, shell, projectile, bomb, and combinations thereof are used interchangeably herein.

The present invention is not limited to wash-out any particular energetic material. Non-limiting examples of energetic materials that can be removed from an explosive projectile using the present invention include: ammonium perchlorate (AP); 2,4,6 trinitro-1,3-benzenediamine (DATB), ammonium picrate (Explosive D); cyclotetramethylene tetranitramine (HMX); nitrocellulose (NC); nitroguanidine (NQ); 2,2-bis[(nirtoxy)methyl]-1,3-propanediol dinitrate (PETN); hexahydro-1,3,5-trinitro-1,3,5-triazine (RDX); 2,4,5-trinitrophenol (TNP); hexahydro-1,3,5-benzenetriamine (TATB); N-methyl N-2,4,6-tetranitrobenzeneamine (Tetryl); 2-methyl-1,3,5-trinitrobenzene (TNT); Amatol (Ammonium Nitrate/TNT); Baratol ($Ba(NO_3)_2$/TNT; black powder ($KNO_3$/S/C); Comp A (RDX/wax); Comp B (RDX/TNT); Comp C (RDX/plasticizer); Cyclotol (RDX/TNT); plastic bonded explosives (PBX); LOVA propellant; NACO propellant; any combination of the above materials; rocket propellant; and Octol (HMX/TNT). Most preferred are Explosive D, HMX, RDX, TNT, and mixtures thereof.

The present invention allows for a high-pressure fluidjet nozzle at the end of a wand to be oscillated within the cavity of and about the longitudinal axis of the object to be washed-out. As previously mentioned, the present invention eliminates the need for heavy duty and complicated rotational equipment that would be required fi the munition were rotated. The present invention will be better understood with reference to the figures hereof. FIG. 1 hereof is a simplified representation of the primary components of the present invention. This FIG. 1 shows subassembly I comprising a nozzle with oscillating components. This assembly I is comprised of a nozzle 34 at the upper end of wand 12 inside of cavity C. Nozzle 34 will contain at least 1 orifice for projecting a high pressure fluid into cavity C. Nozzle 34 controls how the fluid from the fluid jet emanates into the cavity being washed-out. It controls the number and orientation of jets and also has a significant influence on the flow rate of each jet. It is preferred that a plurality a nozzle be used that contains a plurality of orifices of sufficient and effective size positioned symmetrically around the outer surface, preferably on the same horizontal plane. Wand 12 will preferably be of a length of rigid tubular material, preferably a metal tube, more preferably a stainless steel tube. Wand 12 will have a connecting means, for securing nozzle 34 to its upper end. One preferred securing means would be a screw type arrangement where the nozzle would be screwed onto the top of the upper end of wand 12, which will contain receiving threads.

Wand 12 can be oscillated by any suitable oscillating means which is presented in FIG. 1 as component 2. A preferred oscillating means is the use of a rotary actuator. A rotary actuator is a device that is well established in the art and is typically used for applications that require a cyclic reversing angular displacement. The rotary actuator can get its energy from any suitable source. Non-limiting examples of energy sources that can source can be used for the rotary actuator include: pressurized air, pressurized hydraulic liquid, and electricity. Inside of the rotary actuator are mechanical means (mechanical drive train) for converting energy into angular displacement and torque. This mechanical drive train can be of any suitable type, non-limiting example which include a vane, a rack and pinion, and a gear set. Also, any suitable configuration can be used to the output torque to the wand, non-limiting examples, which include a solid shaft, a hollow bore and a turn table. A solid shaft is of the type that would protrude from a standard motor. In some cases, it will be desired that a shaft not be used, but instead there be a hole into which the wand can be secured. It is preferred that the torque of the rotary actuator be coupled to the wand by having the axis of rotation of the wand coincide with the axis of rotation of the rotary actuator. As the rotary actuary travels back and forth, the wand oscillates. Hollow bore rotary actuators are preferred, and if used, the wand can be mounted directly within the actuator and components 24, 18, 20, 22, 26, 10, the sprocket of 2, 44 (shown in figures hereof to follow) can possibly be eliminated and will also make the overall mechanical operation more efficient.

Proximity sensors on the rotary actuator are preferably in communication with a programmable control system that is capable of reversing the direction of the rotary actuator when the rotary actuator reaches a predetermined travel limit. As a result, the wand will oscillate at least 180 degrees, rotating back to center, then rotating 180 degrees to the other side of center. Thus the oscillation simulates rotation of the item if it were rotated. The amount of oscillation in terms of degrees of travel can be readily adjusted by repositioning the proximity sensors. It is preferred that slightly more than 180 degrees, for example about 185 degrees, of travel in each direction occurs to ensure that 360 degrees of oscillation results. If less than 360 degrees of oscillation results, there will be some areas inside the cavity that will not be subjected to high-pressure fluid. It is preferred that the nozzle comprise a plurality of orifices of suitable size and spaced substantially symmetrically around the axis (180 degrees).

Oscillating means 2 is connected to wand 12 by any suitable securing means. The securing means will preferably be substantially a cylindrical bore non-limiting examples which include a gear, sprocket, pulley, bushing, and collet-type. The bore will preferably be concentrically secured to the wand with an effective gripping force. There will also preferably be a means to achieve this gripping force such as one or more set screws and/or the turning of a nut that will expand the outer diameter to grip a tandem element and/or the inner diameter will contact to grip the wand. Wand 12 is fluidly connected to the outlet end of tubular coil 30 by any usable connecting means 28. The inlet end of tubular coil 30 is fluidly connected to a source of high pressure fluid HPF by use of a connecting means 32. This entire assembly is supported by supporting means S which in turn is secured to subassembly II which is a means for providing vertical movement (lifting and lowering) for the entire assembly I.

The fluid of the fluid jet can be any suitable composition that is normally a liquid. By "normally liquid" we mean that it will be in the liquid state at substantially atmospheric temperatures and pressures. For example, it can be water or an organic solvent, in which at least a portion of the energetic or wax component is at least partially soluble. In one preferred embodiment of the present invention, the fluid used to cut out the fuze(s) is water, plus an abrasive, and the fluid used to washout, or cut out, the energetic material from the projectile is also water. It is preferred that the fluid be nontoxic so as to maintain the environmental usefulness of the cutting/demilitarization process. Non-limiting examples of organic solvents suitable for use in the practice of the present invention include: alkyl alcohols, alkyl ketones, alkyl nitriles, nitroalkanes, and halo-alkanes. More particularly, the alkyl group of the organic solvent may be branched, cyclic, or straight chain of from about 3 to 20 carbons. Examples of such alkyl groups include octyl, dodecyl, propyl, pentyl, hexyl, cyclohexyl, and the like. Methanol and ethanol are the preferred alcohols. The alcohols may also contain such alkyl groups. Non-limiting examples of ketones include acetone, cyclohexanone, propanone, and the like. Non-limiting examples of nitro compounds that can used as the carrier for the fluid jet in the practice of the present invention are acetonitrile, propylnitrile, octylnitrile, and the like. Non-limiting examples of halogenated alkanes include methylene chloride, chloroform, tetrahaloethylene and perhaloethane, and the like. Preferably, aqueous and aqueous/organic mixtures are used as the fluid which are more preferably nontoxic and cost effective, given the compatibility with the explosive material to be removed. Such more preferred fluids include, propylene and ethylene glycol, fuel oil compositions such as gasoline and diesel oil, water, short chain alkyl alcohols, mineral oil, glycerine, and mixtures thereof. Water is the most preferred.

The wand is lifted and lowered by use of subassembly II which can be any of a variety of suitable lifting/lowering actuator devices. Non-limiting example of lifting/lowering mechanisms that can be used in the practice of the present invention include those powered by hydraulic, air, or electric sources and contain a drive train that can be of a type such as a lead screw type, ball screw type, chain/sprocket type, piston cylinder type, belt/pulley type, cable/pulley type, linkage type, rack and pinion type and telescoping linear type. Depending on the type of drive train used, an additional linear bearing may be necessary to support and guide the motion along its intended line of motion. Linear bearings come in many forms and are very well established in the art.

Any suitable proximity sensor can be used with the rotary actuator and lifting/lowering actuator of the present invention. A proximity sensor, for purposes of this invention, is a sensor capable of detecting the presence of a nearby object without any physical contact. A proximity sensor typically emits an electromagnetic or electrostatic field, or beam of electromagnetic radiation (such as infrared) and looks for changes in the field of the return signal. The object being sensed is often referred to as the proximity sensor's target. Different proximity sensor targets demand different sensors. For example, a capacitive or photoelectric sensor is suitable for a plastic target and an inductive proximity sensor for a metal target. Proximity sensors are well known in the art and thus a more detailed explanation of them is not needed for purposes of the invention.

In order to be able to oscillate the wand without the use of expensive and short-lived swivel fittings capable of withstanding ultra-high pressure, the present invention preferably uses high-pressure tubing of suitable diameter, such as ¼ inch, that has been specially coiled so that the wand and associated high-pressure tubing has enough flexibility to coil and uncoil as oscillation proceeds. The coil is attached to the wand and the entire mechanism raises and lowers with the wand so that the wand can be readily oscillated and lifted/lowered at the same time. The wand lift/lower rate will preferably range from 0.25 inches per minute to 10 inches per minute, preferably from 5 inches per minute to 2 inches per minute. This rate depends upon the properties of the material being removed from the cavity. Also, the oscillation rate can be programmably controlled by controlling the energy to the rotary actuator. For a pneumatic rotary actuator the energy will be air flow. Typical oscillation rates are from 1 to 50 rpm and again this rate depends upon the properties of the material being removed from the cavity—preferred is 5 to 25 rpm. The operating pressure of the fluid jets will be from about 40,000 to about 120,000 psig, preferably from about 50,000 to about 80,000 psig.

Figure 2:
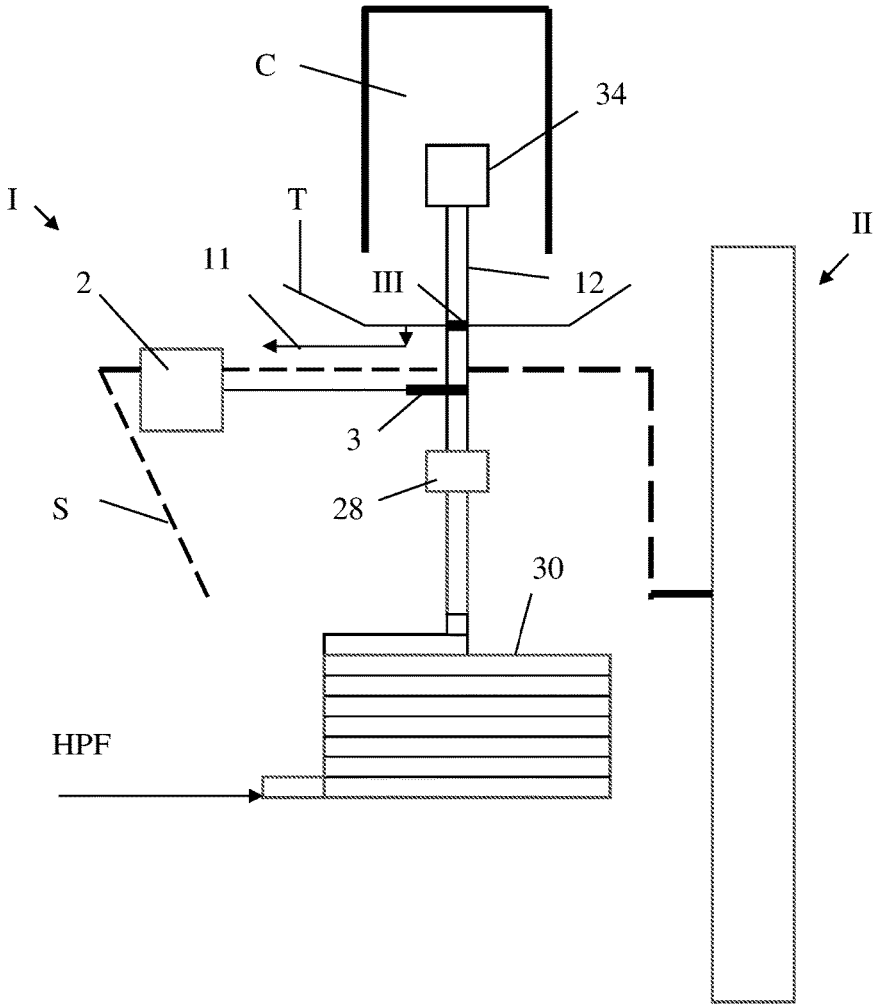
FIG. 2 hereof is a generic representation of the apparatus of the present invention showing a wand projected upward through a trough and into a cavity to be washed-out. There figure also shows a sealing member at the interface of the wand and trough to prevent any of the slurry resulting during wash-out from leaking from the trough.

FIG. 2 hereof is the oscillating assembly of FIG. 1 above, but with wand 12 extended through trough T and showing a seal subassembly III, a preferred embodiment of which is shown in FIG. 9 hereof. FIG. 2 also shows coil 30 not secured to support structure S so that it can be allowed to be extended, or stretched so it can be secured at floor or ground level. If secured at ground level a suitable number of coils will have to comprise coil 30.

Figure 3:
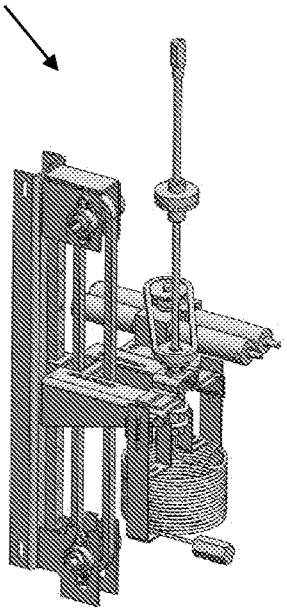
FIG. 3 hereof is a perspective view of one preferred embodiment of an oscillator assembly of the present invention illustrating three main components parts, mechanism (I) illustrated in FIG. 3A for oscillating the wand of the fluid jet apparatus; mechanism (II) illustrated in FIG. 3B hereof for lifting the wand assembly, and mechanism (III) illustrated in FIG. 3C hereof for the seal subassembly for containing wash-out slurry.
Figure 3C:
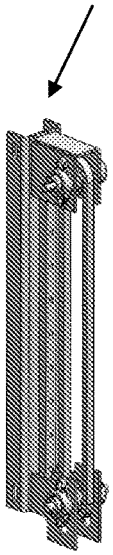
Figure 3B:
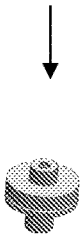
Figure 3A:
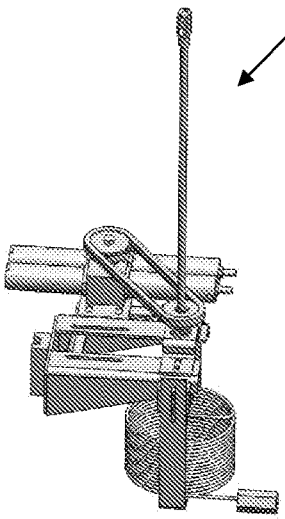

FIG. 3 hereof is a representation of a preferred embodiment of oscillating assembly O of the present invention, which is comprised of three subassemblies. Subassembly I, illustrated in FIG. 3A hereof, is a mechanism for providing oscillating movement to a fluid jet wand/nozzle system. Subassembly II, illustrated in FIG. 3B hereof, is a mechanism for providing vertical movement to a wand, and subassembly III, illustrated in FIG. 3C hereof, is a preferred a seal assembly for containing the resulting washout slurry.

Figure 4:
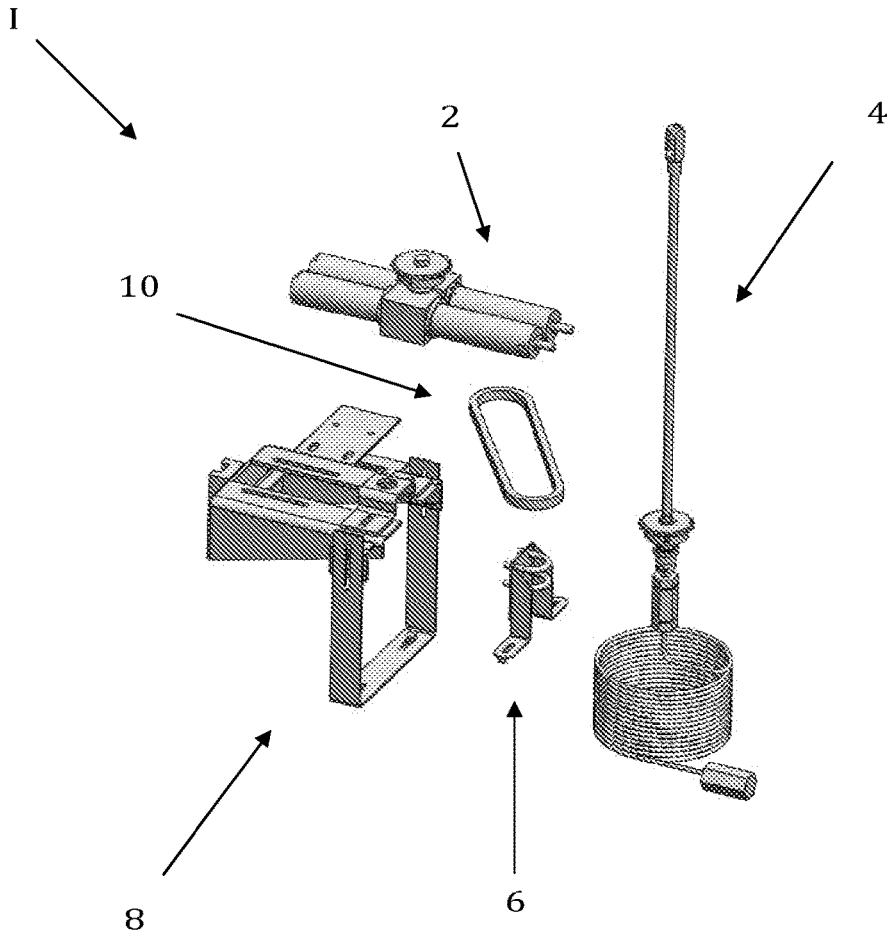
FIG. 4 hereof is a blowup view of parts of mechanism (I) for oscillating the wand of the fluid jet apparatus.
Figure 5:
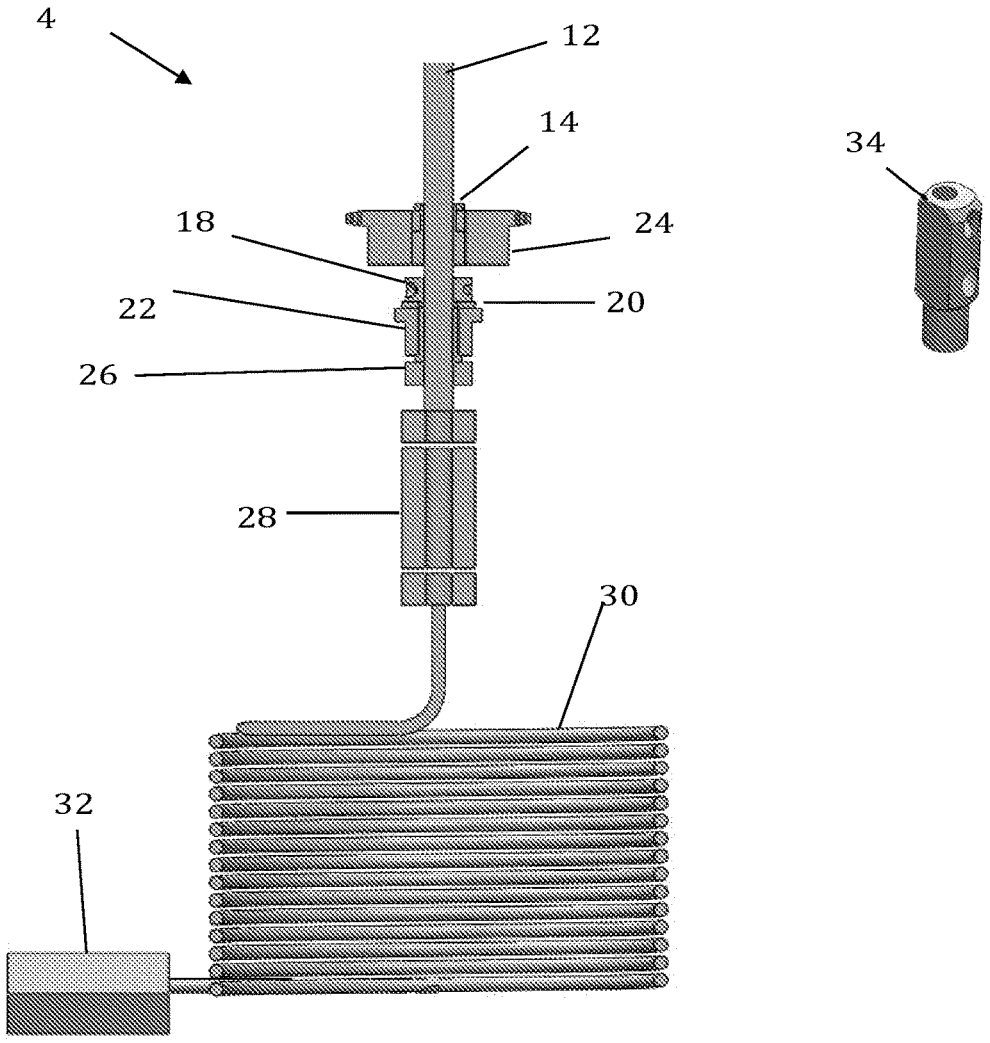
FIG. 5 hereof is a side view cut along a center vertical plane, of the wand coil subassembly.

FIG. 4 hereof is an exploded view of preferred subassembly I, which is capable of providing oscillating movement to wand 12. It is comprised of: a pneumatic rotary actuator 2, a wand-coil subassembly 4, a torque arm 6, a supporting structure 8 and a drive chain 10. FIG. 5 hereof is a cross-sectional, along the center vertical axis, of wand-coil subassembly 4. Wand-coil subassembly 4 is preferably comprised of: a wand 12; a shaft clamp 14; a sprocket 16; a top collar 18, a thrust bearing 20, a support bushing 22; a sleeve bearing 24 a bottom collar 26; an outlet adapter 28 with integral locking nuts 29, a coil 30; an inlet adapter 32 and a wash head, or nozzle, 34 to be fitted at the open end of wand 12. Wand 12 will preferably be of a rigid tubular form, preferably a metal tube, more preferably a stainless steel tube. Support bushing 22 is the primary support for wand-coil subassembly 4. It is the means by which lifting power is transmitted to subassembly 4. It is also the means by which wand 12 is restrained to its two desired degrees of freedom—oscillation about its axis and axial translation. The support bushing is secured to the wand support (component 44 of subassembly 8) by any suitable means, which for purposes of the instant figures is by way of a cut-out in the wand support with its shoulder resting on and welded to the wand support.

When the wand support is lifted, it moves upwards into the shoulder of the support bushing. In order for support bushing 22 to lift the wand, or to transfer this power to the wand, it must be restrained from sliding upwards along the axis of the wand. Top collar 18 is clamped to the wand to allow this power transmission. Upon lifting, support bushing 22 is driven into the top collar which in turn lifts the wand. During simultaneous lifting and oscillating, two sets of surfaces will be sliding against each other with pressure. The first set of surfaces is the top of support bushing 22 and the bottom of top collar 18. In order to minimize friction a thrust bearing 20 is used which is located between support bushing 22 and top collar 18. It is preferred that thrust bearing 20, which will be in the form of a washer, be composed of a material with a low coefficient of friction, such as a plastic or Teflon material. The second set of surfaces is the inner cylindrical wall of support bushing 22 and the outer wall of the wand 12. In order to minimize this friction a sleeve bearing 24 is used which is located at this interface. It is preferred that sleeve bearing 24 be a circular plastic tube having a shoulder. Bottom collar 26 serves to retain sleeve bearing 24 and to assist in lowering the wand in the unlikely scenario when power is needed to lower the wand. For example, the weight of subassembly I will generally be more than enough to overcome any resistance to the lowering of the wand, however, if one or more of the components become dirty or worn with time, or if there is substantial binding between the wand and subassembly III, then it may become necessary to use power to lower the wand.

Shaft clamp 14 serves to secure sprocket 16 to wand 12. In order to transmit torque in a reliable and mechanically sound manner from the sprocket to the wand it must be attached concentrically and securely. Shaft clamp 14 allows for non-standard and miss-matched diameter components to be securely attached while remaining substantially concentric. Sprocket 16 serves to transmit oscillation power to wand 12, which serves to channel high pressure fluid, preferably water, into nozzle 34. Nozzle 34 controls how the fluid from the fluid jet emanates into the cavity being washed-out. It controls the number and orientation of jets and also has a significant influence on the flow rate or each jet. Nozzle 34 will be one that is capable of converting the high pressure fluid into one or more high velocity fluid jet streams. Outlet adapter 28 serves to connect the outlet of the coil 30 to the inlet of wand 12. Coil 30 is capable of allowing angular displacement of the wand without requiring the use of a high pressure swivel. Inlet adapter 32 connects the high pressure water to the coil 30. That is, it has an inlet end capable of receiving and securing the high pressure fluid line and an outlet end capable of being secured to coil 30.

Figure 6:
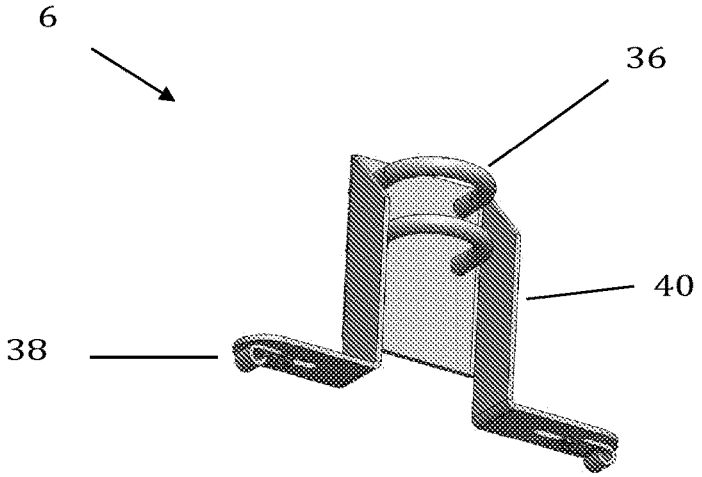
FIG. 6 hereof is a perspective view, of the torque arm of the mechanism for oscillating the fluid jet wand.

FIG. 6 hereof is a perspective view of torque arm 6 which is comprised of three integral components: a pair of U-bolts 36; two loop clamps 38 and a main body 40. Wand 12 is attached to coil 30 through the outlet adapter 28 (FIG. 3). As the wand oscillates, it transmits a substantial amount of torque to coil 30 Consequently, the small gland nut or lock nut 29 on the bottom end of the adapter will be relied upon to transfer this torque. Torque arm 6 serves to transfer the torque from outlet adapter 28 directly to coil 30, bypassing lower locknut 29, which will typically be smaller than upper locknut 29. The two U-bolts 36 secure adapter body 28 to torque arm 6, which secures to two opposing points on the top loop of the coil with the two loop clamps 38.

Figure 7:
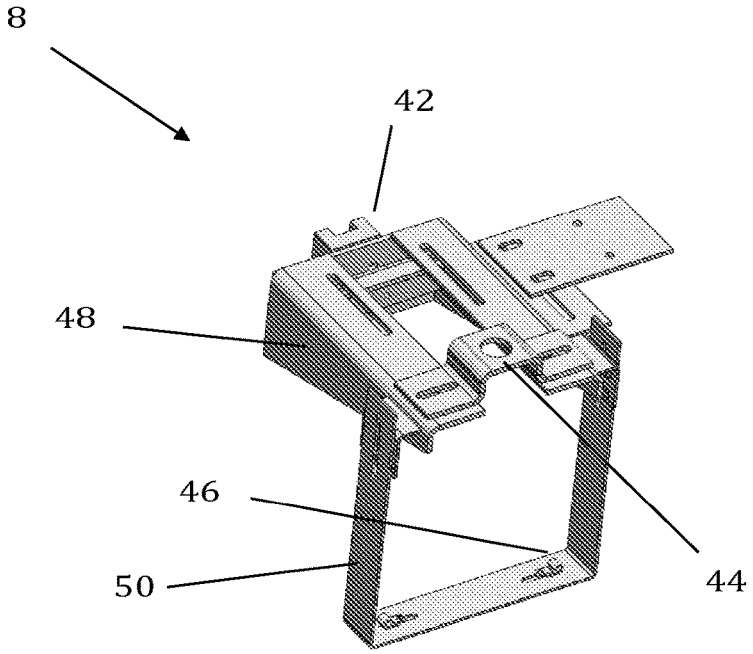
FIG. 7 hereof is a perspective view of the support structure for the mechanism for oscillating the fluid jet wand.

FIG. 7 hereof is a perspective view of supporting structure 8 of subassembly I and is comprised of: a guide block 42; wand support 44; two loop clamps 46; body 48; and coil support 50. It will be noted that coil support 50 can be eliminated if the bottom coil of coil 30 were secured to ground level. It is preferred to eliminate coil support 50 and secure the bottom coil of coil assembly 30 to the ground or floor. One advantage of this is that the source of high pressure fluid can be more easily and effectively fluidly attached to the coil. Guide block 42 is a bearing that is capable of retaining the motion of the supporting structure and ultimately that of wand 12 to translate along the vertical axis. It interfaces with rail 54 of subassembly II. Body 48 is a suitable structural component to which the guide block 42, wand support 44, coil support 50, pneumatic rotary actuator 2, and chain 56 of subassembly II are secured. Wand support 44 is the primary support component for the wand-coil subassembly 4.

Figure 8:
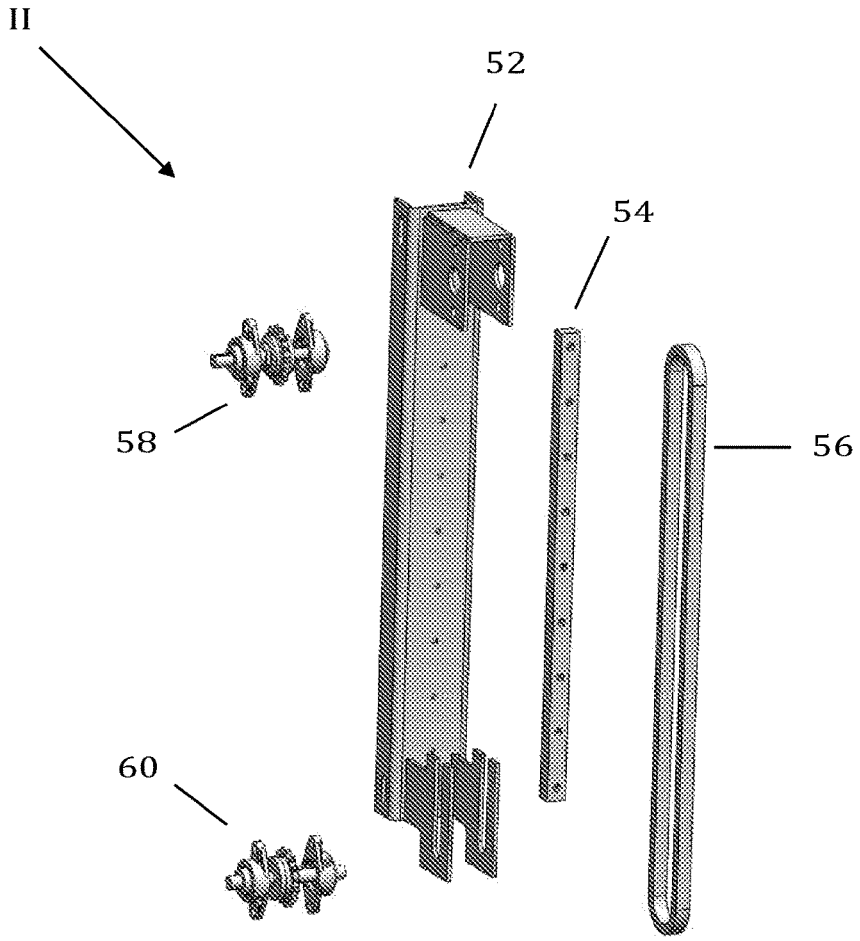
FIG. 8 hereof is an exploded view of the subassembly for providing vertical movement of the fluid jet wand.

FIG. 8 hereof is an exploded view of the subassembly II which is the mechanism for providing vertical movement to wand 12. Subassembly II is comprised of: body 52, rail 54; chain 56; drive shaft assemblies 58; and 60. Each drive shaft assembly of this preferred embodiment will be comprised of two bearings, one sprocket and one shaft. Whichever lift shaft assembly is chosen to be driven can also contain a "torque limiter". The torque limiter will act as a safety to limit the amount of force that can be delivered to the wand to lift it upwards into the cavity be washed-out. This will keep damage to a minimum if the wand should be lifted into something rigid. Body 52 acts as a structure to mount the two drive shaft assemblies 58 and 60, rail 54 and chain 56. One of the two drive shaft assemblies must be driven in order to move chain 56. It is preferred to drive upper assembly 58. Rail 54 interfaces with guide block 42 and serves to restrain the motion of wand 12 to a translation along the vertical axis. Chain 56 is secured to the body of the supporting structure and transmits the lifting power to the wand-coil Subassembly 4.

Figure 9A:
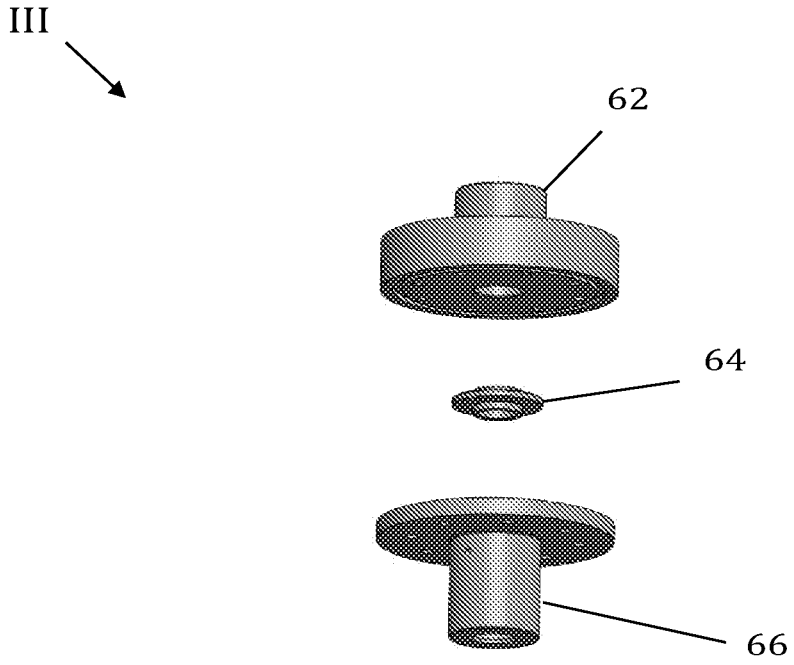
FIGS. 9A and 9B hereof are exploded and cross-sectional views, respectively, of the seal assembly.
Figure 9B:
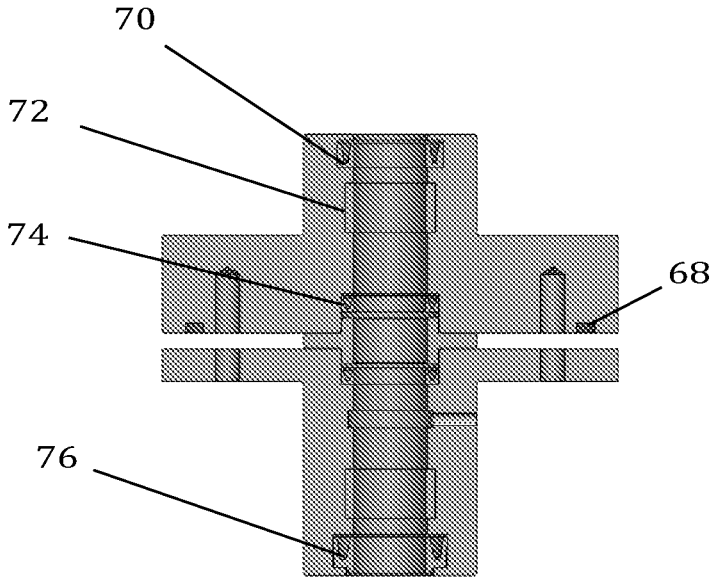

FIG. 9A hereof is an exploded view of seal subassembly III and FIG. 9B is a cross-sectional view cut along the longitudinal axis of seal subassembly III. Seal subassembly HI is comprised of the following integral parts: top flange 62; centering ring 64; bottom flange 66; O-ring 68; U-cup 70; two wear rings 72; two seals 74; and excluder 76. In general, seal subassembly III is a three piece housing in which one or more sealing elements (in the illustrated preferred case, an o-ring, two seals, two wear inserts, a u-cup and an excluder that reside to form a seal at the interface of the wand and through it translates and oscillates within. A top and bottom flange is necessary to form a seal by clamping together on opposing sides of the bottom surface of the trough. A centering ring is used to ensure that the close tolerances of the sealing elements in the flanges are maintained during mounting of the two flanges.

Figure 10:
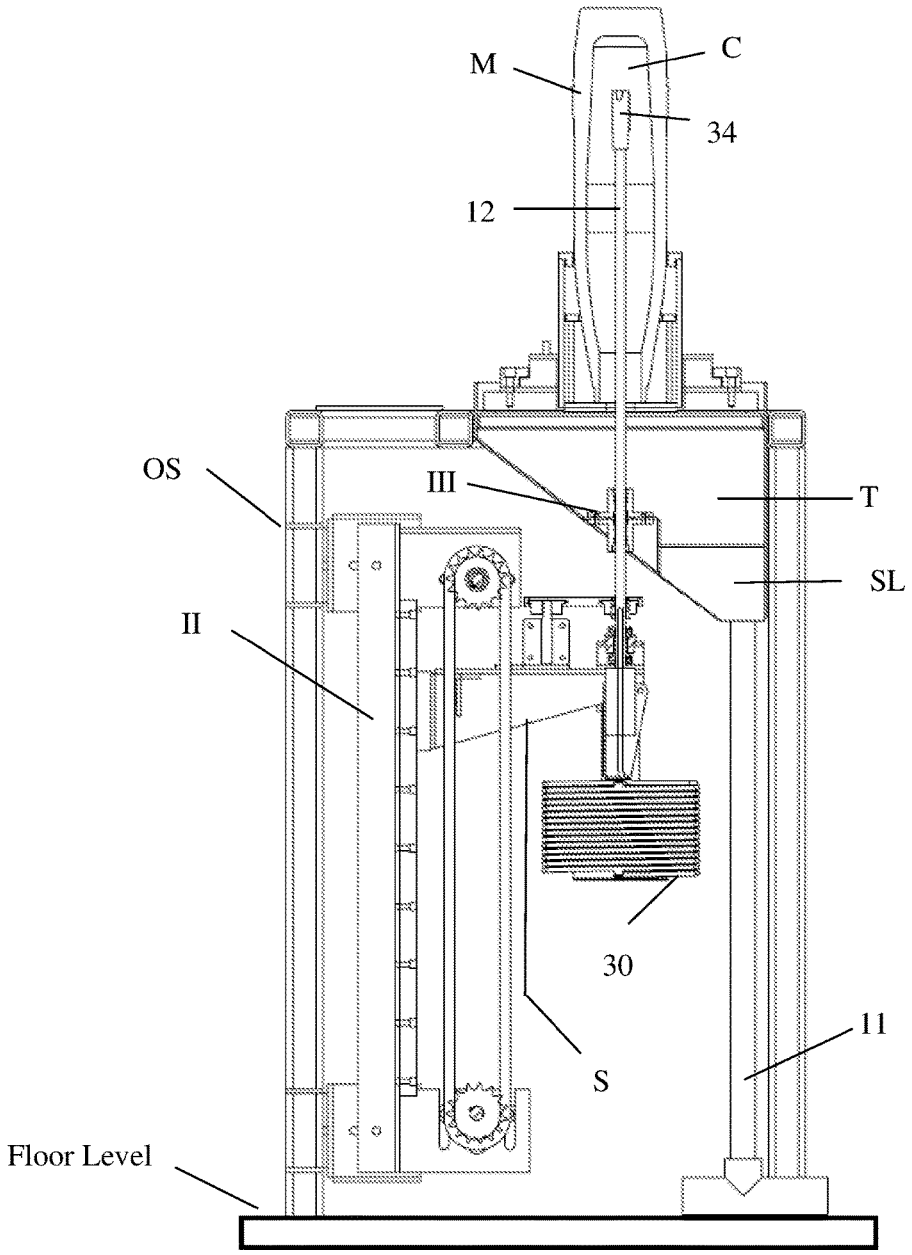
FIG. 10 hereof shows the preferred embodiment of FIGS. 3-9B, but mounted on an overall support structure OS that includes a trough T and a drain that preferably is connected to an eductor.

FIG. 10 hereof is an illustration of the preferred embodiment of FIGS. 3 to 9B hereof, but positioned in use under and secured to second supporting structure OS. This figure shows a munition M having a cavity C which had been washed-out by use of wand 12 and nozzle 34. Also shown is a trough T into which is collected the resulting slurry SL comprised of the fluid used for wash-out and the material that is washed-out. Seal assembly III is shown that prevents any slurry material from leaking from the interface of wand 12 and trough T. Eductor 11 carries the slurry from trough to downstream disposal or further processing. Coil 30 can be secured at floor level of secured to support S.

What is claimed is:

1. An apparatus for delivering one or more jets of high pressure fluid to washout a material contained within a containing space defined by enclosing walls, which apparatus comprises:

a) a wand comprised of a length of metallic tubing having an outlet end and an inlet end;

b) a nozzle containing one or more orifices for delivering one or more jets of fluid at a pressure from about 40,000 to about 120,000 psig, which nozzle being in fluid communication and secured to the outlet end of said wand;

c) a tubular coiled structure in the form of a plurality of horizontally positioned loops wherein there is a top loop and a bottom loop, and having an outlet end extending substantially vertically from said top loop and an inlet end extending from the bottom loop, wherein said outlet end of said tubular structure is fluidly connected to the inlet end of said wand and wherein said inlet end of said tubular coiled structure is fluidly connected to a source of high pressure fluid; wherein said tubular coil structure is secured at floor level;

d) a mechanism for oscillating said wand about its longitudinal axis; and e) a first supporting structure for supporting at least some of items of a)-d) above; and f) a means for translating said wand along its longitudinal axis for extending said wand and nozzle upward into the interior of said containing space and downward out of said containing space.

2. The apparatus of claim 1 wherein the tubular coiled structure is secured at floor level by its bottom loop.

3. The apparatus of claim 1 wherein the tubular coiled structure is secured to first supporting member.

4. The apparatus of claim 3 wherein the tubular coiled structure is secured to said first supporting member by its bottom loop.

5. The apparatus of claim 1 wherein the rotary actuator is of the hollow core type.

6. The apparatus of claim 1 wherein the rotary actuator is pneumatically activated, hydraulically activated, or electrically activated.

7. The apparatus of claim 6 wherein the mechanical drive train of said rotary actuator is selected from vane, rack and pinion, and a gear set.

8. The apparatus of claim 1 wherein the means for translating vertical movement to the wand is by way of a linear actuator.

9. The apparatus of claim 8 wherein the linear actuator is pneumatically activated, hydraulically activated, or electrically activated.

10. The apparatus of claim 1 wherein the mechanism for oscillating said wand is a rotary actuator having a mechanical drive train.

* * * * *